US006622945B1

(12) United States Patent
Wu et al.

(10) Patent No.: US 6,622,945 B1
(45) Date of Patent: Sep. 23, 2003

(54) SHOWER HEAD STRUCTURE

(76) Inventors: James Wu, No. 1, Alley 16, Lane 40, Jinn Te Road, Taichung (TW); Len Gen Yan, No. 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 10/374,204

(22) Filed: Feb. 27, 2003

(51) Int. Cl.[7] ..... A62C 31/00
(52) U.S. Cl. ..... 239/443; 239/583
(58) Field of Search ..... 239/526, 443, 239/444, 446–449, 407, 413, 414, 569, 583

(56) References Cited

U.S. PATENT DOCUMENTS 5,433,384 A * 7/1995 Chan et al. ..... 239/449
5,735,467 A * 4/1998 Lee ..... 239/414

* cited by examiner

*Primary Examiner*—Lisa A. Douglas

(57) ABSTRACT

A shower head structure, comprising a body, a front housing, a push button, a water guide member, a flow switch disk, a first water outlet panel, a second water outlet panel, and a third water outlet panel. Thus, the user can operate the push button by his one hand only, so as to switch and adjust the water flow, thereby facilitating the user switching and adjusting the water flow of the shower head. In addition, the user can press the push button to switch and adjust the water flow through the first water outlet panel, the second water outlet panel and the third water outlet panel, thereby enhancing the versatility of the shower head.

17 Claims, 5 Drawing Sheets

SHOWER HEAD STRUCTURE

BACKGROUND OF THE INVENTION

1. Field of the Invention

The present invention relates to a shower head structure, and more particularly to a shower head structure, wherein the user can operate the push button by his one hand only, so as to switch and adjust the water flow, thereby facilitating the user switching and adjusting the water flow of the shower head structure.

2. Description of the Related Art

A conventional shower head in accordance with the prior art comprises a flow switch disk, and a water outlet panel. In operation, the flow switch disk is used to switch the water flow flowing through the water outlet panel, thereby achieving a multi-stage water flow. However, the user has to hold the shower head by his one hand, and to rotate the water outlet panel by his other hand, so as to switch the water flow, thereby causing inconvenience to the user in adjustment of the shower head.

SUMMARY OF THE INVENTION

The present invention has arisen to mitigate and/or obviate the disadvantage of the conventional shower head.

The primary objective of the present invention is to provide a shower head structure, wherein the user can operate the push button by his one hand only, so as to switch and adjust the water flow, thereby facilitating the user switching and adjusting the water flow of the shower head.

Another objective of the present invention is to provide a shower head structure, wherein the user can press the push button, so as to switch and adjust the water flow through the first water outlet panel, the second water outlet panel and the third water outlet panel, thereby enhancing the versatility of the shower head.

A further objective of the present invention is to provide a shower head structure, wherein when the push button is pressed, the wedge-shaped block of the push button pushes and moves the ratchet teeth of the flow switch disk, thereby forcing the flow switch disk to rotate, so that the holes in the flow switch disk located at different positions are rotated with the flow switch disk to align with the first water outlet panel, the second water outlet panel and the third water outlet panel respectively, so as to switch the water flow, thereby forming a multi-stage water flow.

In accordance with the present invention, there is provided a shower head structure, comprising a body, a front housing, a push button, a water guide member, and a flow switch disk, wherein:

the body has a first end formed with a water inlet end and a second end formed with a seat, the seat of the body has a lower portion formed with a guide channel, the guide channel has a side formed with a breach;

the front housing is mounted on the body and is formed with a recessed seat, the seat of the front housing has a lower portion formed with an opening, the front housing has a lower portion formed with a guide channel aligning with the guide channel of the body, the guide channel of the front housing has a side formed with a breach aligning with the breach of the body;

the push button is mounted between the guide channel of the body and the guide channel of the front housing, the push button has first end slidably mounted between the guide channel of the body and the guide channel of the front housing and a second end protruding outward from the breach of the body and the breach of the front housing, the first end of the push button has a top formed with a receiving seat slidably mounted in the opening of the front housing, a wedge-shaped block is mounted in the receiving seat of the push button and is partially protruded outward from the receiving seat of the push button;

the water guide member is mounted in the seat of the front housing;

the flow switch disk is rotatably mounted on the water guide member, the flow switch disk has a surface formed with a plurality of holes located at different positions, the flow switch disk has an outer periphery formed with a plurality of ratchet teeth engaged with the wedge-shaped block of the push button.

Further benefits and advantages of the present invention will become apparent after a careful reading of the detailed description with appropriate reference to the accompanying drawings.

DETAILED DESCRIPTION OF THE INVENTION

Figure 1:
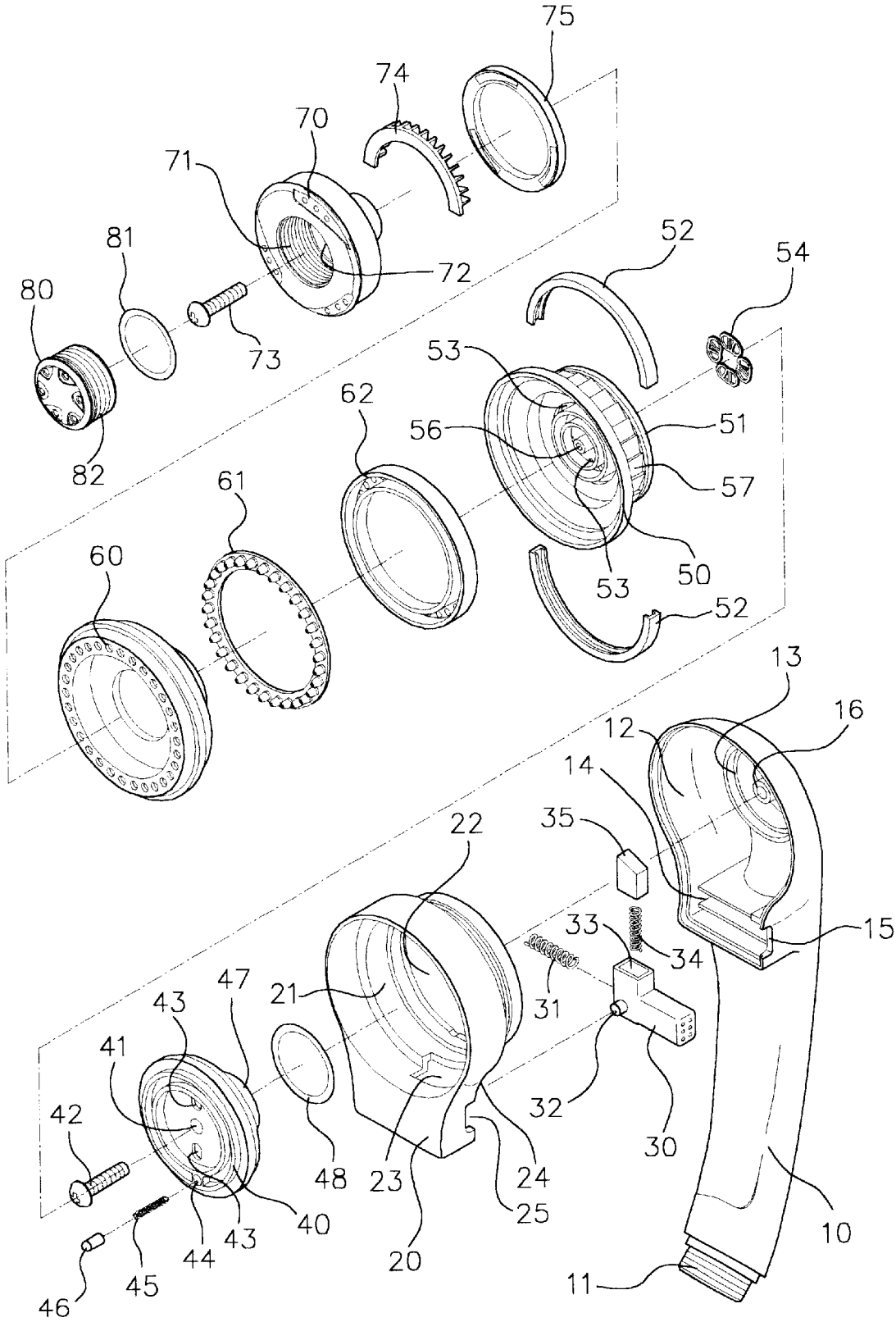
FIG. 1 is an exploded perspective view of a shower head structure in accordance with a preferred embodiment of the present invention.
Figure 2:
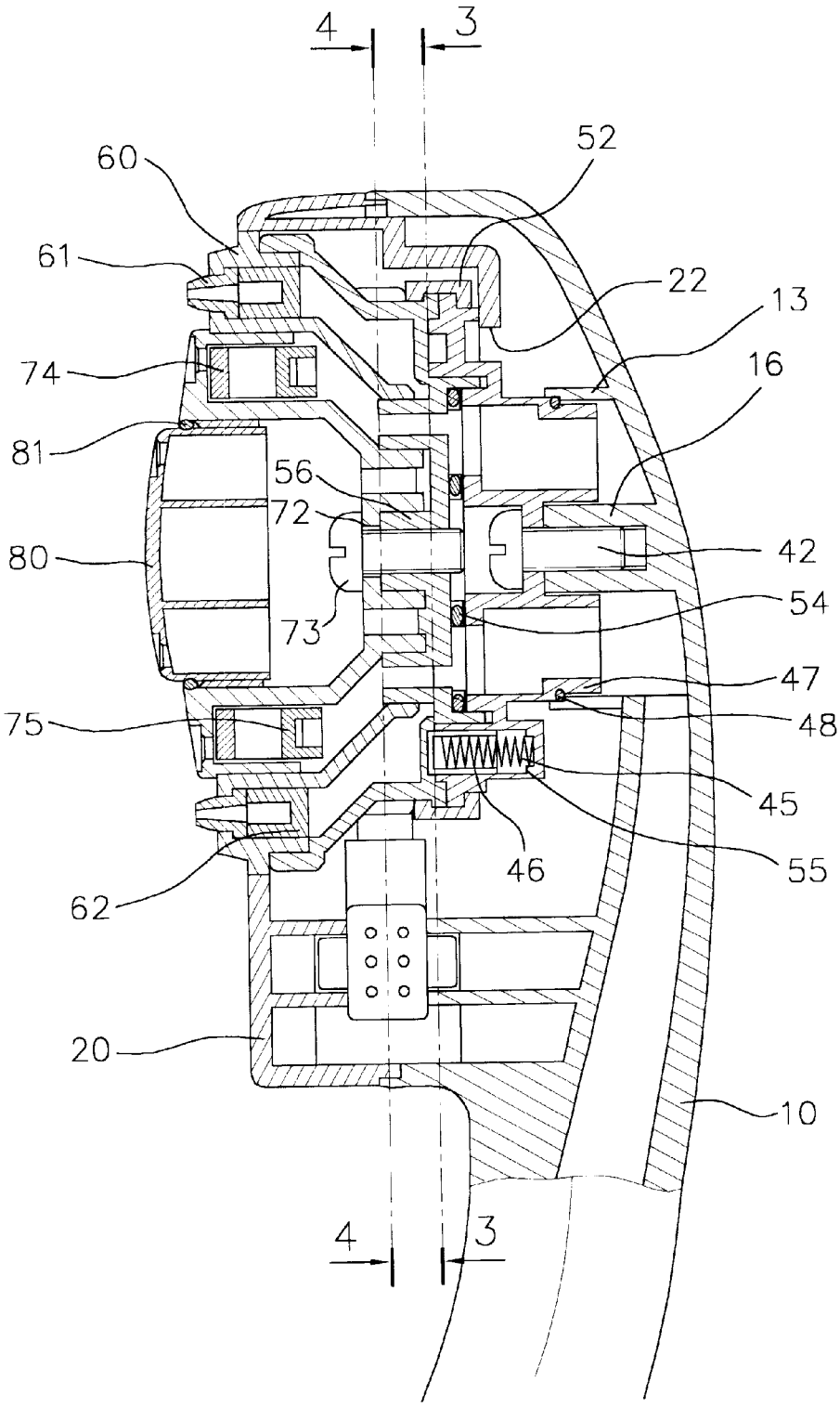
FIG. 2 is a partially cut-away side plan cross-sectional assembly view of the shower head structure as shown in FIG. 1.
Figure 3:
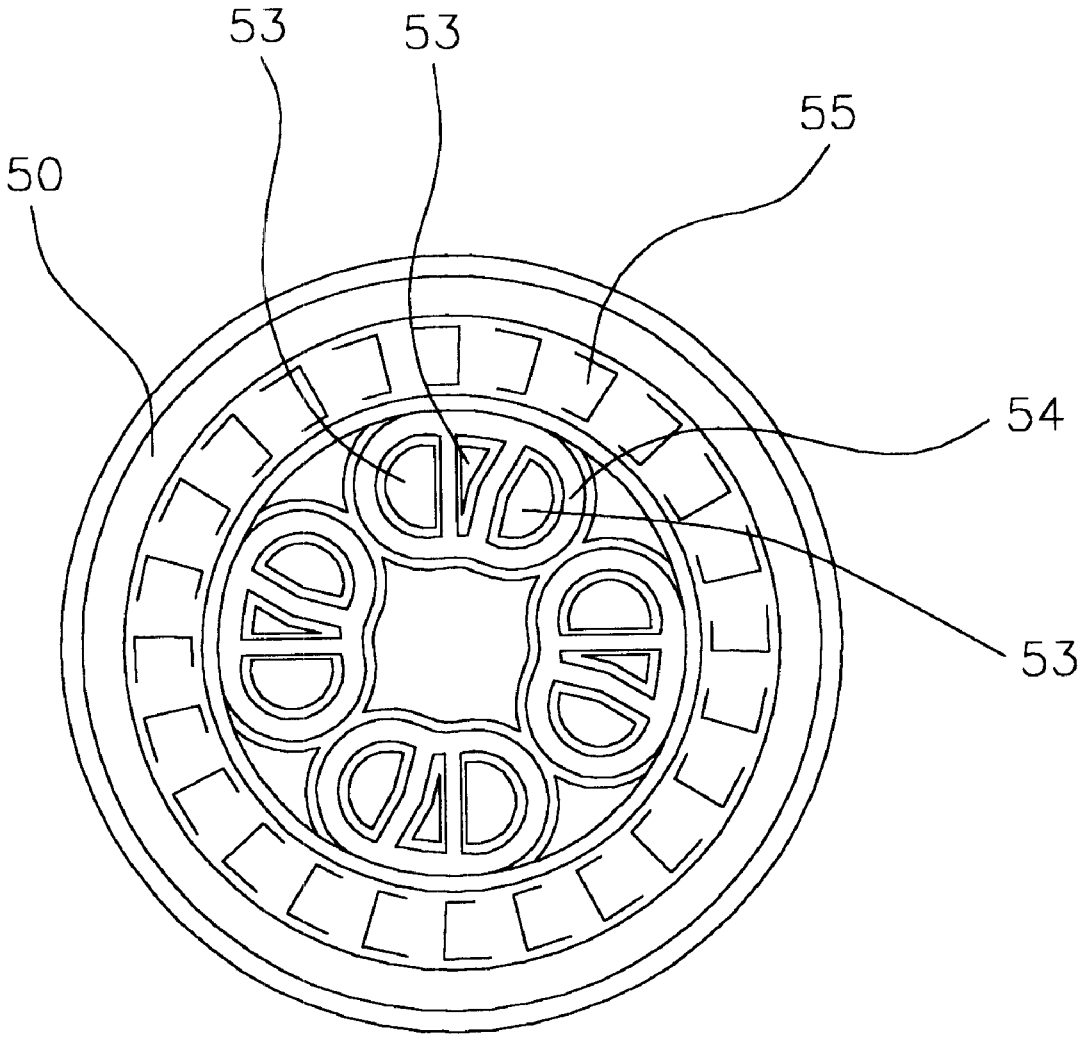
FIG. 3 is a plan cross-sectional view of the shower head structure taken along line 3—3 as shown in FIG. 2.
Figure 4:
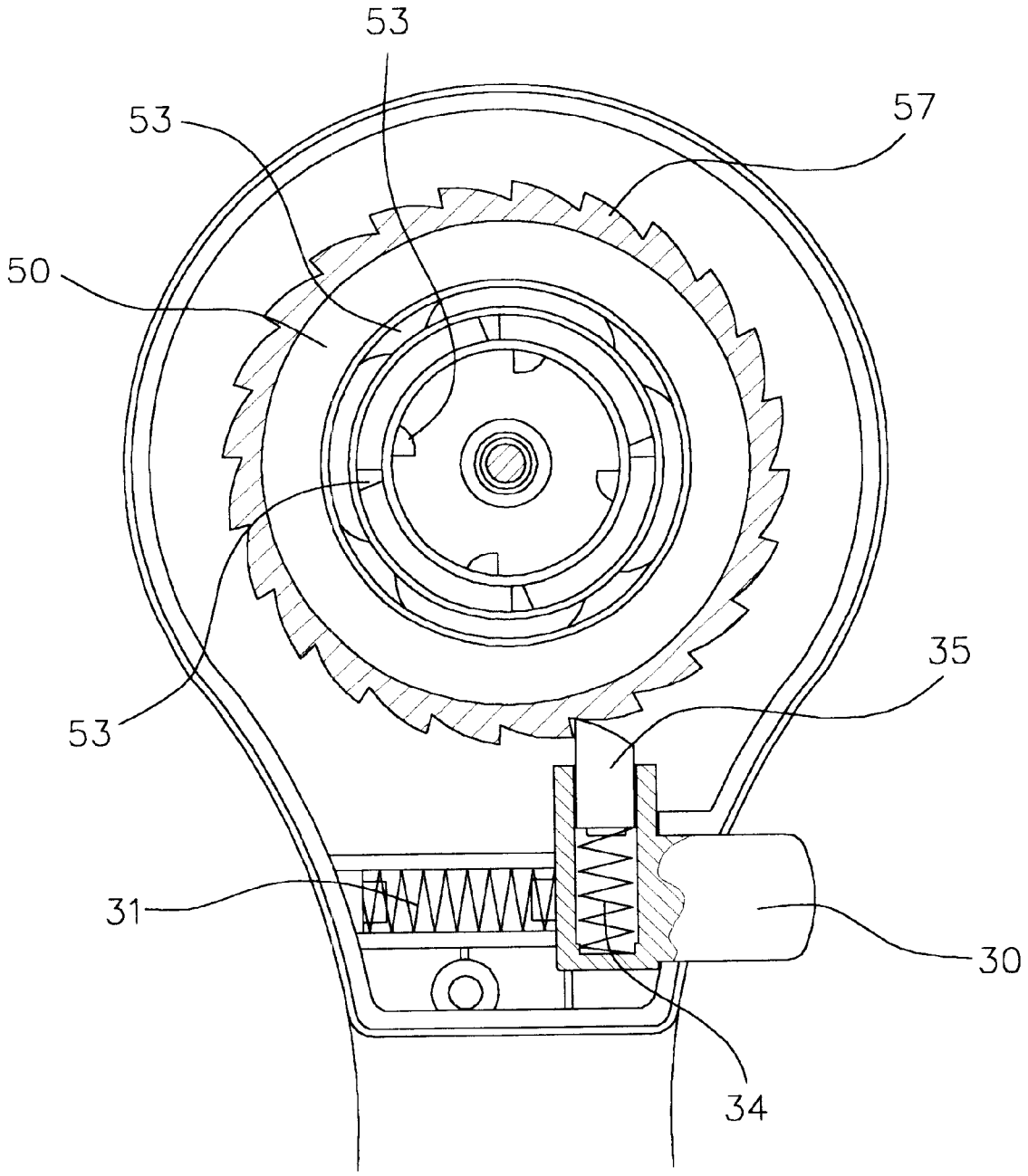
FIG. 4 is a plan cross-sectional view of the shower head structure taken along line 4—4 as shown in FIG. 2.

Referring to the drawings and initially to FIGS. 1–4, a shower head structure in accordance with a preferred embodiment of the present invention comprises a body 10, a front housing 20, a push button 30, a water guide member 40, a flow switch disk 50, a first water outlet panel 60, a second water outlet panel 70, and a third water outlet panel 80.

The body 10 has a first end formed with a water inlet end 11 and a second end formed with a seat 12. The seat 12 of the body 10 has a wall formed with an annular protruding fixing seat 16 and an annular flange 13 located outside of the fixing seat 16. The seat 12 of the body 10 has a lower portion formed with a guide channel 14. The guide channel 14 has a side formed with a breach 15.

The front housing 20 is mounted on the body 10 and is formed with a recessed seat 21. The seat 21 of the front housing 20 has a wall formed with a hole 22. The seat 21 of the front housing 20 has a lower portion formed with an opening 23. The front housing 20 has a lower portion formed with a guide channel 24 aligning with the guide channel 14 of the body 10. The guide channel 24 of the front housing 20 has a side formed with a breach 25 aligning with the breach 15 of the body 10.

The push button 30 is mounted between the guide channel 14 of the body 10 and the guide channel 24 of the front housing 20. The push button 30 has first end slidably mounted between the guide channel 14 of the body 10 and the guide channel 24 of the front housing 20 and a second end protruding outward from the breach 15 of the body 10 and the breach 25 of the front housing 20. The first end of the push button 30 has two sides each formed with a stub 32 slidably inserted into the guide channel 14 of the body 10 and the guide channel 24 of the front housing 20O. A first compression spring 31 is mounted in the seat 12 of the body 10 and has a first end urged on the first end of the push button 30 and a second end urged on the seat 12 of the body 10. The first end of the push button 30 has a top formed with a receiving seat 33 slidably mounted in the opening 23 of the front housing 20. A wedge-shaped block 35 is mounted in the receiving seat 33 of the push button 30 and is partially protruded outward from the receiving seat 33 of the push button 30. A second compression spring 34 is mounted in the receiving seat 33 of the push button 30 and has a first end urged on the wedge-shaped block 35 and a second end urged on the receiving seat 33 of the push button 30.

The water guide member 40 is mounted in the seat 21 of the front housing 20 and has a disk shape. The water guide member 40 has a center formed with a hole 41. A locking screw 42 is extended through the hole 41 of the water guide member 40, and is screwed into the fixing seat 16 of the body 10, thereby securing the water guide member 40 on the body 10. The water guide member 40 has a surface formed with a plurality of water outlet holes 43. The water guide member 40 has a periphery formed with a receiving recess 44 for receiving a third compression spring 45 and a positioning block 46, wherein the third compression spring 45 is urged between the positioning block 46 and a wall of the receiving recess 44 of the water guide member 40. The water guide member 40 has a side formed with a protruding lug 47 inserted into the annular flange 13 of the body 10. A waterproof O-ring 48 is mounted between the protruding lug 47 of the water guide member 40 and the annular flange 13 of the body 10.

The flow switch disk 50 is rotatably mounted on the water guide member 40. The flow switch disk 50 is formed with a protruding flange 51 rested on the surface of the water guide member 40. Two semi-circular snapping members 52 are mounted on the protruding flange 51 of the flow switch disk 50, for locking the flow switch disk 50 on the water guide member 40. The flow switch disk 50 has a surface formed with a plurality of holes 53 each having a periphery provided with a waterproof gasket 54. Preferably, the holes 53 in the flow switch disk 50 are located at different positions. The flow switch disk 50 has a first side formed with a plurality of concave portions 55 (see FIG. 3) for insertion of the positioning block 46 of the water guide member 40. The flow switch disk 50 has an outer periphery formed with a plurality of ratchet teeth 57 engaged with the wedge-shaped block 35 of the push button 30. The flow switch disk 50 has a second side formed with a fixing seat 56.

The first water outlet panel 60 is mounted in the flow switch disk 50 and contains a water outlet auxiliary washer 61 and a fixing ring 62 therein, wherein the fixing ring 62 is used to fix the water outlet auxiliary washer 61.

The second water outlet panel 70 is mounted in the first water outlet panel 60. The second water outlet panel 70 has a first end formed with a recessed threaded seat 71 and a second end provided with a flow guide ring 74 and a water outlet blocking ring 75. The threaded seat 71 of the second water outlet panel 70 has a wall formed with a hole 72. A locking screw 73 is extended through the hole 72 of the threaded seat 71 of the second water outlet panel 70, and is screwed into the fixing seat 56 of the flow switch disk 50, thereby securing the second water outlet panel 70 on the flow switch disk 50.

The third water outlet panel 80 is mounted on the second water outlet panel 70, and is formed with an outer threaded section 82 screwed into the threaded seat 71 of the second water outlet panel 70. A waterproof O-ring 81 is mounted between the third water outlet panel 80, and the second water outlet panel 70.

Figure 5:
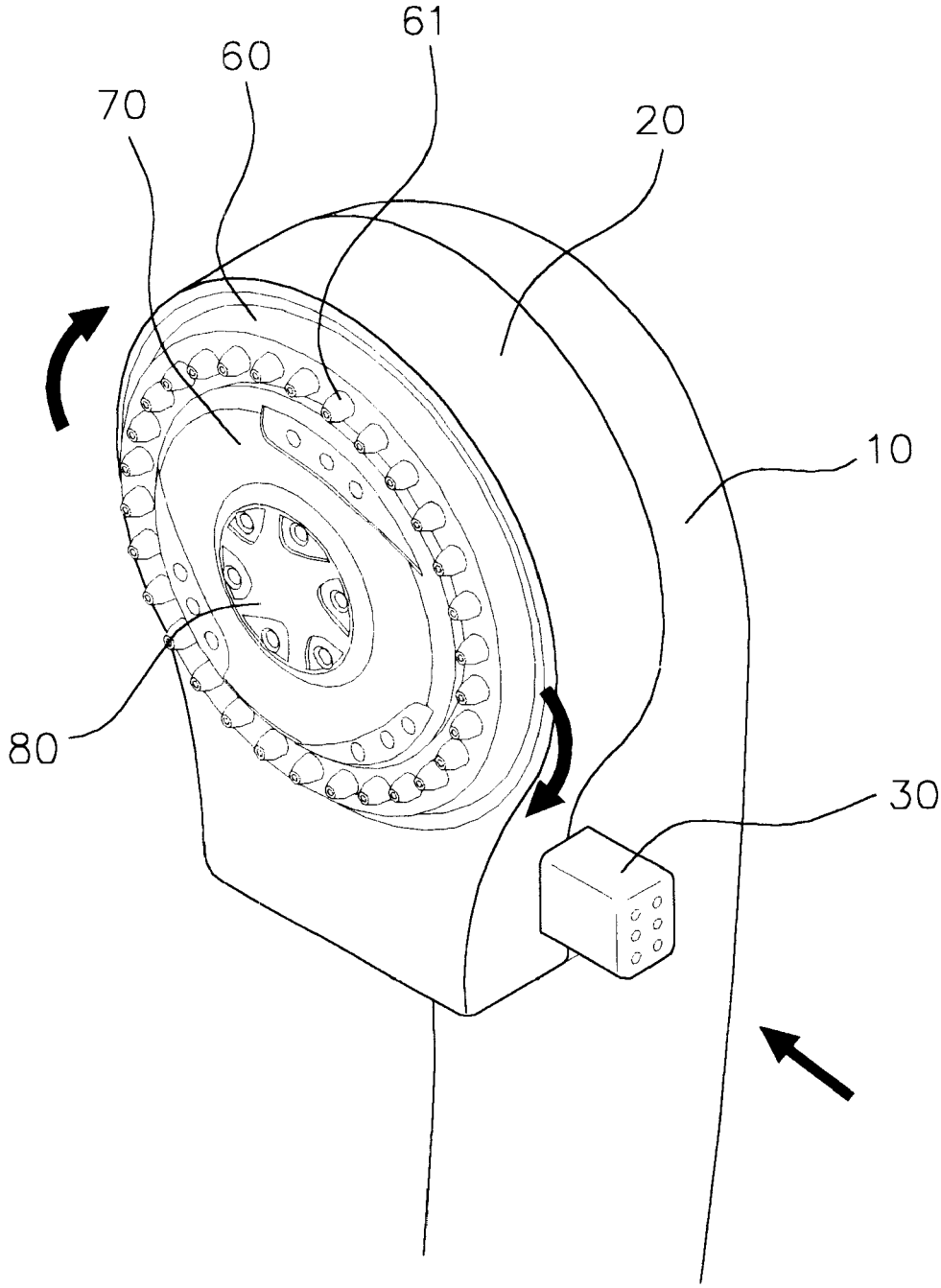
FIG. 5 is a perspective assembly operational view of the shower head structure in accordance with the preferred embodiment of the present invention.

In operation, referring to FIGS. 1–5, the water guide member 40 introduces and guides the water flow into the flow switch disk 50. The user can press and push the push button 30, so that the wedge-shaped block 35 of the push button 30 pushes and moves the ratchet teeth 57 of the flow switch disk 50, thereby forcing the flow switch disk 50 to rotate. At this time, the holes 53 in the flow switch disk 50 located at different positions are rotated with the flow switch disk 50 to align with the first water outlet panel 60, the second water outlet panel 70 and the third water outlet panel 80 respectively, thereby switching the water flow.

Accordingly, the user can operate the push button 30 by his one hand only, so as to switch and adjust the water flow through the first water outlet panel 60, the second water outlet panel 70 and the third water outlet panel 80, thereby facilitating the user switching and adjusting the water flow, and thereby enhancing the versatility of the shower head.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head structure, comprising a body, a front housing, a push button, a water guide member, and a flow switch disk, wherein:

the body has a first end formed with a water inlet end and a second end formed with a seat, the seat of the body has a lower portion formed with a guide channel, the guide channel has a side formed with a breach;

the front housing is mounted on the body and is formed with a recessed seat, the seat of the front housing has a lower portion formed with an opening, the front housing has a lower portion formed with a guide channel aligning with the guide channel of the body, the guide channel of the front housing has a side formed with a breach aligning with the breach of the body;

the push button is mounted between the guide channel of the body and the guide channel of the front housing, the push button has first end slidably mounted between the guide channel of the body and the guide channel of the front housing and a second end protruding outward from the breach of the body and the breach of the front housing, the first end of the push button has a top formed with a receiving seat slidably mounted in the opening of the front housing, a wedge-shaped block is mounted in the receiving seat of the push button and is partially protruded outward from the receiving seat of the push button;

the water guide member is mounted in the seat of the front housing;

the flow switch disk is rotatably mounted on the water guide member, the flow switch disk has a surface formed with a plurality of holes located at different positions, the flow switch disk has an outer periphery formed with a plurality of ratchet teeth engaged with the wedge-shaped block of the push button.

2. The shower head structure in accordance with claim 1, wherein the seat of the body has a wall formed with an annular protruding fixing seat, the water guide member has a center formed with a hole, and the shower head structure further comprises a locking screw extended through the hole of the water guide member and screwed into the fixing seat of the body, thereby securing the water guide member on the body.

3. The shower head structure in accordance with claim 1, wherein the seat of the body has a wall formed with an annular flange, the water guide member has a side formed with a protruding lug inserted into the annular flange of the body, and the shower head structure further comprises a waterproof O-ring mounted between the protruding lug of the water guide member and the annular flange of the body.

4. The shower head structure in accordance with claim 1, wherein the seat of the front housing has a wall formed with a hole.

5. The shower head structure in accordance with claim 1, wherein the first end of the push button has two sides each formed with a stub slidably inserted into the guide channel of the body and the guide channel of the front housing.

6. The shower head structure in accordance with claim 1, further comprising a first compression spring mounted in the seat of the body and having a first end urged on the first end of the push button and a second end urged on the seat of the body.

7. The shower head structure in accordance with claim 1, further comprising a second compression spring mounted in the receiving seat of the push button and having a first end urged on the wedge-shaped block and a second end urged on the receiving seat of the push button.

8. The shower head structure in accordance with claim 1, wherein the water guide member has a surface formed with a plurality of water outlet holes.

9. The shower head structure in accordance with claim 1, wherein the water guide member has a periphery formed with a receiving recess for receiving a third compression spring and a positioning block, and the third compression spring is urged between the positioning block and a wall of the receiving recess of the water guide member, and the flow switch disk has a first side formed with a plurality of concave portions for insertion of the positioning block of the water guide member.

10. The shower head structure in accordance with claim 1, wherein the flow switch disk is formed with a protruding flange rested on the surface of the water guide member.

11. The shower head structure in accordance with claim 10, further comprising two semi-circular snapping members mounted on the protruding flange of the flow switch disk for locking the flow switch disk on the water guide member.

12. The shower head structure in accordance with claim 1, wherein each of the holes of the flow switch disk has a periphery provided with a waterproof gasket.

13. The shower head structure in accordance with claim 1, further comprising a first water outlet panel mounted in the flow switch disk and containing a water outlet auxiliary washer and a fixing ring therein, wherein the fixing ring is used to fix the water outlet auxiliary washer.

14. The shower head structure in accordance with claim 13, further comprising a second water outlet panel mounted in the first water outlet panel and having a first end formed with a recessed threaded seat and a second end provided with a flow guide ring and a water outlet blocking ring.

15. The shower head structure in; accordance with claim 14, wherein the flow switch disk has a second side formed with a fixing seat, the threaded seat of the second water outlet panel has a wall formed with a hole, and the shower head structure further comprises a locking screw extended through the hole of the threaded seat of the second water outlet panel and screwed into the fixing seat of the flow switch disk, thereby securing the second water outlet panel on the flow switch disk.

16. The shower head structure in accordance with claim 14, further comprising a third water outlet panel-mounted on the second water outlet panel and formed with an outer threaded section screwed into the threaded seat of the second water outlet panel.

17. The shower head structure in accordance with claim 16, further comprising a waterproof O-ring mounted between the third water outlet panel and the second water-outlet panel.

* * * * *